United States Patent [19]

Jabagchourian et al.

[11] Patent Number: 4,506,244

[45] Date of Patent: Mar. 19, 1985

[54] HIGH VOLTAGE RELAY

[75] Inventors: Hrair Jabagchourian, Carpenteria; Louis Lucas, Jr., Santa Barbara, both of Calif.

[73] Assignee: Kilovac Corporation, Santa Barbara, Calif.

[21] Appl. No.: 618,044

[22] Filed: Jun. 7, 1984

[51] Int. Cl.[3] ..... H01H 1/66

[52] U.S. Cl. ..... 335/151; 335/187; 200/144 B

[58] Field of Search ..... 335/126, 131, 151, 154, 335/155, 156, 187, 202, 203; 200/144 B

[56] References Cited

U.S. PATENT DOCUMENTS

| | | | |
|---|---|---|---|
| 2,908,780 | 10/1959 | Walters | 200/144 B X |
| 3,312,803 | 4/1967 | Perry et al. | 335/151 X |
| 3,336,664 | 8/1967 | Hawkins | 200/144 B X |
| 3,699,486 | 10/1972 | De Lucia | 200/144 B X |

*Primary Examiner*—George Harris

*Attorney, Agent, or Firm*—Christie, Parker & Hale

[57] ABSTRACT

A small high-voltage sealed relay with an axially movable armature and moving contact. The moving contact is electrically connected to a fixed wiring terminal by a pair of coil springs arranged within the terminal and slidably engaging opposite side surfaces of the moving contact. This arrangement simplifies assembly of the relay, and provides good reliability at high operating voltages in the range of 100 kilovolts.

6 Claims, 10 Drawing Figures

Fig. 1
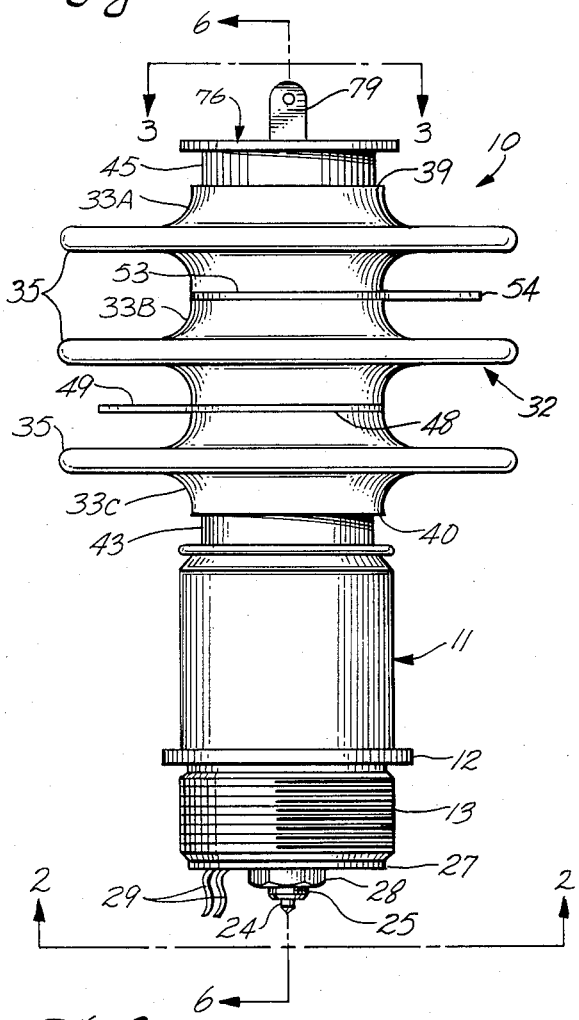
Fig. 3
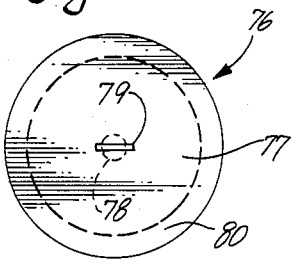
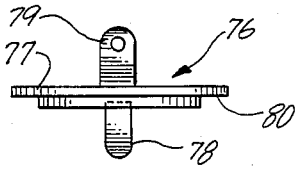
Fig. 4
Fig. 5
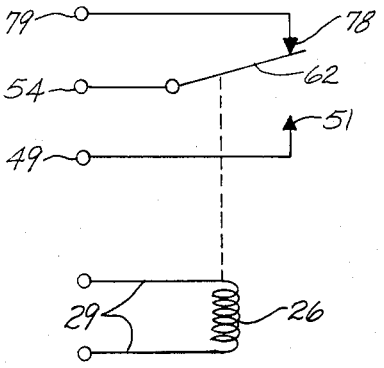
Fig. 2
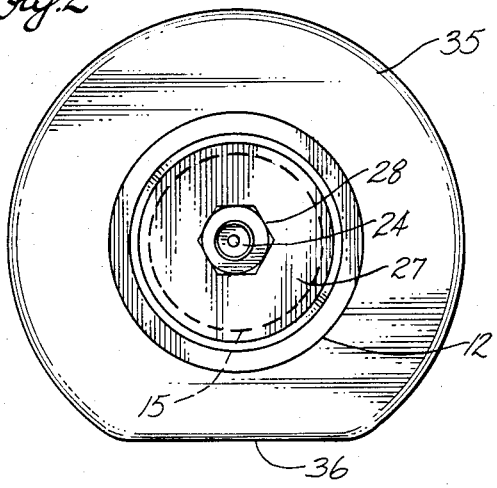

HIGH VOLTAGE RELAY

BACKGROUND OF THE INVENTION

Sealed relays are in common use for high-voltage switching, and are typically either evacuated to a high vacuum, or evacuated and backfilled with a dielectric gas such as sulphur hexafluoride. A typical relay of this style is shown in U.S. Pat. No. 3,411,118, and these devices are widely used in communications equipment, high-voltage power supplies, and other electrical apparatus requiring rapid and dependable switching of high currents at high operating voltages.

The relay of this invention is designed for operations at very high operating voltages such as 100 kilovolts, and is used, for example, in electrostatic systems where a "crowbar" circuit is needed. The relay may be operated in air, but is preferably immersed in oil to increase the breakdown voltage between external termainals. Finned ceramic spacers are also provided in the relay body to lengthen the breakdown path between the external terminals.

A particular advantage of the new relay arises from use of an axially movable armature and moving-contact assembly which is inserted within a cylindrical relay housing as one of the final steps of assembly. This construction minimizes need for relay adjustment before sealing, and simplifies assembly procedures for reduced manufacturing cost.

The relay is disclosed in the form of a single-pole double-throw (SPDT) switch with normally closed and normally open fixed terminals. The relay is deisgned, however, to be easily modified to a single-pole single-throw (SPST) configuration with either normally open or closed contacts.

SUMMARY OF THE INVENTION

This invention is directed to a sealed evacuated or pressurized high-voltage relay of generally cylindrical construction, and using an axially movable actuating armature and moving contact. External high-voltage terminals of the relay are separated by stacked finned ceramic insulators, and internal connection to the tubular moving contact is made through a pair of coil springs which make a low-friction sliding fit against opposite sides of the moving contact. The armature, moving contact, and an insulating rod which structurally connects these parts are a subassembly which is fitted into the relay body during final assembly. After functional testing, the relay is then sealed by a top plate, and evacuated (and usually backfilled with a pressurized insulating gas) to complete the product.

BRIEF DESCRIPTION OF THE DRAWINGS

FIG. 1 is a side elevation of a relay according to the invention;

FIG. 2 is a bottom view on line 2—2 of FIG. 1;

FIG. 3 is a top view of a top plate assembly on line 3—3 of FIG. 1;

FIG. 4 is a side view of the top plate;

FIG. 5 is an electrical schematic of the relay;

DESCRIPTION OF THE PREFERRED EMBODIMENT

Figure 6:
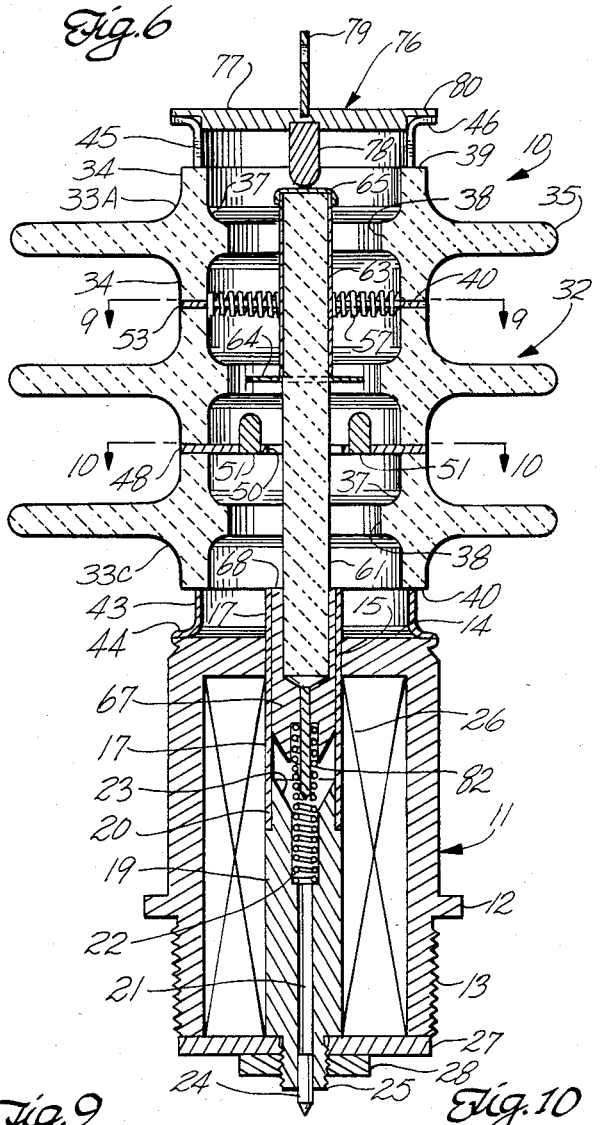
FIG. 6 is a slightly enlarged sectional elevation on line 6—6 of FIG. 1.

Referring to FIGS. 1, 2 and 6, a sealed relay 10 according to the invention is provided in a generally cylindrical upright housing, the lower portion of which is a coil-supporting tubular base 11 machined from a ferrous magnetic alloy. A conventional mounting flange 12 extends radially from the outer surface of the base, and the lower end of the base is provided with external threads 13 to receive a mounting nut (not shown). The bottom of hollow base 11 is open, and a top surface 14 of the base extends radially inwardly to a central bore 15.

A hollow cylindrical guide tube 17 is made of a non-magnetic material such as Monel alloy, and the tube extends through bore 15 to project both above and below the top surface of base 11. The tube is brazed to the base top surface to be rigidly secured in central coaxial alignment with the center line of the base.

A magnetic-alloy pole piece 19 has a recessed upper end 20 which fits snugly within and is brazed to the lower end of guide tube 17. The tubular pole piece has a central bore 21 which is slightly enlarged in diameter at its upper end to define a spring-seating cavity 22. The upper end of cavity 22 is outwardly conically tapered to define a seat 23. A sealable tubulation 24 is press fitted into the lower end of bore 21, and brazed to the pole piece. The lower end of the pole piece is slightly reduced in diameter, and provided with external threads 25.

A conventional electromagnet coil 26 (shown schematically in FIG. 6) is fitted into the annular space between the inner surface of base 11 and the outer surface of the centrally positioned guide tube and pole piece. A disk-shaped coil cover plate 27 of a magnetic alloy is fitted over the threaded lower end of the pole piece, and is secured in place by a clamping nut 28 after the coil is installed. Connecting wires 29 (FIG. 1) to the coil extend through cover plate 27.

The next major subassembly of relay 10 is an upper housing 32 formed by a plurality of stacked ceramic insulating rings 33A–C. The rings are substantially identical in shape, and each ring has an annular sidewall 34 with an external flange-like fin 35 extending radially therefrom. As shown in FIG. 2, each fin 35 is generally circular in planform, but has a flattened portion 36 to prevent the relay from rolling if it is placed on its side.

Each ring 33 also has a short inwardly extending fin 37 terminating in a cylindrical surface 38 which forms a central opening through the ring. The ring has flat upper and lower ends 39 and 40, and is made from an alumina ceramic as conventionally used in high-voltage insulators.

The upper and lower ends of each ring are metallized, and a metal base ring 43, preferably made of a Kovar alloy, is brazed to lower end 40 of lowermost insulating ring 33C. The lower end of the base ring is formed as a radially outwardly extending mounting flange 44. A similarly formed Kovar-alloy top ring 45 with an outwardly extending mounting flange 46 is brazed to the metallized upper end 39 of upper insulating ring 33A.

Figure 10:
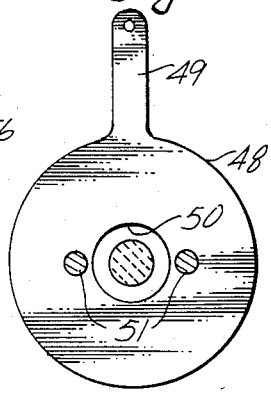
FIG. 10 is a top view of a lower fixed terminal plate on line 10—10 of FIG. 6.

A fixed terminal plate 48 (FIGS. 6 and 10) is sandwiched between and brazed to the upper end of lower insulating ring 33C and the lower end of intermediate insulating ring 33B. Plate 48 is circular in planform, and has an outside diameter which matches the outside diameter of the sidewalls of the adjacent insulating rings. A wiring terminal 49 extends radially outwardly from one edge of the terminal plate to be positioned between the adjacent insulating rings as shown in FIG. 1. A central circular opening 50 is formed through the terminal plate, and a pair of tungsten contact pins 51 are positioned on opposite sides of the opening. The contact pins are cylindrical posts with rounded upper ends as shown in FIG. 6, and they are brazed to the contact plate.

A common terminal plate 53 (FIGS. 6 and 9) is positioned above fixed terminal plate 48, and is sandwiched between and brazed to the upper end of intermediate insulating ring 33B and the lower end of upper insulating ring 33A. This ring is also preferably made of Kovar alloy, which is a good conductor, and which brazes well to the metalized surfaces of the ceramic insulating rings. Plate 53 is similar to plate 48 with respect to outside diameter, and in that it has a radially outwardly extending wiring terminal 54 which extends between the adjacent insulating rings as shown in FIG. 2.

Plate 53 has an enlarged central opening 55 and two pairs of facing, radially inwardly extending mounting tabs 56 are integrally formed on the inner surface of the generally ring-shaped plate. A pair of slightly compressed coil springs 57 and 58 are fitted over these tabs (during a later stage of assembly as described below) to extend across central opening 55 on opposite sides of the axial center line of the upper housing assembly.

Figure 7:
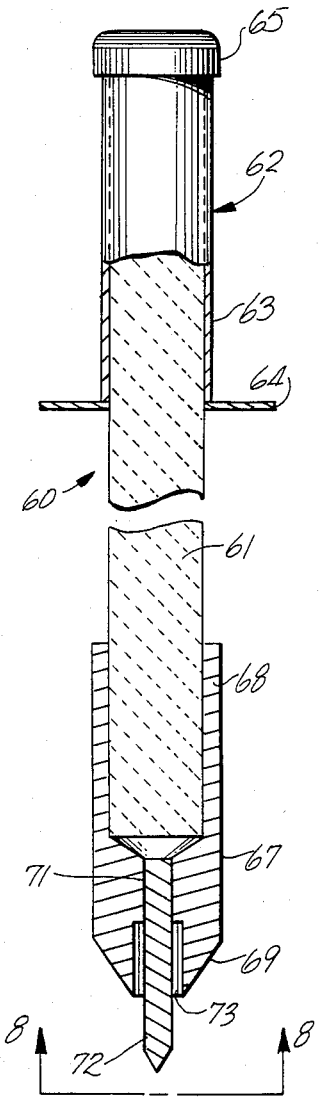
FIG. 7 is an enlarged side elevation of a plunger assembly, partly broken away and in section.

The third major subassembly of relay 10 is a plunger assembly 60 (FIGS. 6, 7 and 8) which includes a cylindrical insulating rod 61 preferably made of a glass-filled epoxy material (or a non-outgassing material such as sapphire or alumina ceramic if the relay interior is maintained at a high vacuum). Fitted over the upper end of rod 61 is a movable common contact 62 which comprises a metal tube 63, a radially outwardly extending bottom flange 64, and a top cap 65. Tube 63 is preferably made of copper, and can be either press fitted or epoxy cemented (if the relay interior is pressurized, rather than maintained at a high vacuum when adhesive outgassing is a problem) to the upper end of rod 61. Bottom flange 64, which is shaped as a circular washer, is made of a high-voltage contact material which is preferably molybdenum, and the flange is brazed to the lower end of tube 63. Top cap 65 is also preferably made of molybdenum, and is brazed to the top of tube 63.

A magnetic-alloy armature 67 is generally cylindrical, and has a hollow upper end 68 which is press-fitted over and preferably epoxy cemented to the lower end of insulating rod 61. The outer cylindrical surface of armature 67 is carefully finished to make a precision slip fit within guide tube 17 of base 11 when the relay is assembled as described below. The lower end of the armature defines a conically tapered portion 69 which is configured to mate with the tapered recess or seat 23 in the upper end of pole piece 19 (FIG. 6).

Figure 8:
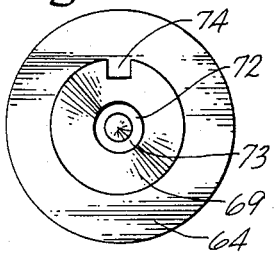
FIG. 8 is an end view on line 8—8 of FIG. 7.

A central bore 71 extends into the lower end of armature 67, and a metal spring-guide pin 72 is press fitted in the central bore and preferably brazed to the armature. A lower portion of central bore 71 is enlarged in diameter to form an annular spring-seating cavity 73. As shown in FIG. 8, an axially extending venting recess or groove 74 is formed in the side surface of the armature to avoid an actuation-slowing dashpot action when the armature is moved within guide tube 17.

The final major subassembly of relay 10 is a top terminal plate 76 (FIGS. 1, 3, 4, and 6) which comprises a circular cap 77, a centrally positioned fixed contact pin 78 extending from the undersurface of the cap, and an external wiring terminal 79 extending upwardly from the center of the cap. Cap 77 and terminal 79 are preferably made of Kovar alloy, and contact pin 78 is a cylindrical tungsten post having a rounded lower end. A radially outwardly extending flange 80 is formed at the top of cap 77 to mate with the upper end of top ring 45 as shown in FIG. 6.

Figure 9:
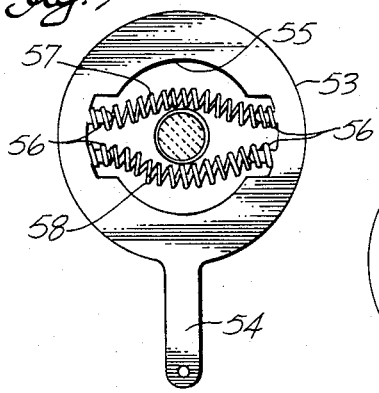
FIG. 9 is a top view of a common terminal plate on line 9—9 of FIG. 6.

The relay is assembled by T.I.G. welding the bottom of mounting flange 44 of base ring 43 to top surface 14 of base 11 as shown in FIG. 6. Springs 57 and 58 are also fitted over tabs 56 at this assembly stage so the springs extend across the open center of terminal plate 53 (FIG. 9). An armature return spring 82 (FIG. 6) is fitted over spring guide pin 72 at the lower end of armature 67 to seat in cavity 73. Plunger assembly 60 is then inserted within the relay body (a small tool is used to spread springs 57 and 58 apart to provide a clearance space for bottom flange 64), and armature 67 is fitted into guide tube 17 and pressed downwardly until the lower end of armature return spring 82 is fully seated in cavity 22 in the upper end of pole piece 19.

At this stage of assembly, top terminal plate 76 can be temporarily secured in position as shown in FIG. 6, and coil 26 inserted within base 11 so the relay can be subjected to electrical and mechanical functional testing. If everything is in order, assembly is completed by T.I.G. welding flange 80 of the top terminal plate to mounting flange 46 of top ring 45. The now-sealed interior of the relay is then evacuated through tubulation 24 (which is subsequently compressively sealed and trimmed) if the relay is to operate as a high-vacuum relay.

Alternatively, the interior of the relay is backfilled after evacuation with an insulating gas such as sulfur hexafluoride. If an insulating gas is used, the relay is typically pressurized with the gas to approximately 150 psi. After coil 26 is installed, coil cover plate 27 is fitted over threads 25 at the lower end of pole piece 19, and secured in place by nut 28.

As described above, relay 10 is configured as a single-pole double-throw switch with cap 65 of movable contact 62 normally closed against fixed contact 78, the plunger assembly being urged into this position by the restoring force exerted by compressed spring 82. When coil 26 is energized, the force of spring 82 is magnetically overcome, and armature 67 is drawn toward and into the upper end of pole piece 19, breaking contacts 65 and 78, and moving the plunger assembly downwardly until contact flange 64 bottoms on fixed contact pins 51. This SPDT switching action is shown schematically in FIG. 5.

A feature of the invention is that the relay can be easily produced in either normally open (NO) or normally closed (NC) SPST configurations. In a NO SPST arrangement, uppermost insulating ring 33A is deleted, and a shorter contact 78, metal tube 63, and rod 61 are used to enable the bottom of ring 45 to be brazed to the upper end of common terminal plate 53. In this configuration, terminals 54 and 79 are in common connection, and either one of the terminals may be deleted. In a NC SPST arrangement, fixed terminal plate 48 and lower insulating ring 33C are deleted, and a shorter rod 61 and metal tube 63 are used to enable the bottom of ring 33B to be brazed directly to base ring 43.

When high potentials in the range of 100 kilovolts are to be switched, the entire upper housing 32 is either plotted or immersed in transformer oil to maximize the breakdown potential between the external high-voltage terminals and other surfaces. For lower potentials, the relay exterior may be operated in air (with the sealed interior being either evacuated, or backfilled with an insulating gas), and fins 35 provide the desired long breakdown path between the external terminals, terminal plates, and metallized ends of the insulating rings. Smaller internal fins 37 serve the same function, but they can be short due to the dielectric properties of the high vacuum or insulating gas (e.g., sulfur hexafluoride at a pressure of 8 to 10 atmospheres) in the sealed interior of the relay.

The sealed interior chamber of the relay is intentionally small in volume to reduce the stored energy of pressurized backfilled insulating gas, and thereby to minimize the need for handling precautions. This also provides a small external envelope to simplify relay installation. In a typical configuration, relay 10 is about five inches long from mounting flange 12 to the end of terminal 79, and external fins 35 of the insulating ceramic rings are about three and one-half inches in diameter.

The use of a pair of captive springs 57 and 58 in terminal plate 53 enables simple final assembly of the relay as described above, while providing dependable electrical connection to tube 63 of the moving contact. The frictional drag of the springs on tube 63 is light, insuring rapid movement of the plunger assembly when the relay coil is energized or deenergized. Typical make-or-break operating times are in the range of 15 to 30 milliseconds. The springs are easily spread apart to permit installation of the plunger assembly during final assembly, and the need for awkward and time-consuming internal soldering or brazing operations at this assembly stage is eliminated.

There has been described a novel high-voltage switching relay of simplified and flexible construction, and which is well suited to a variety of switching applications such as typically encountered in electrostatic systems, X-ray equipment, dielectric-strength test equipment, and high-voltage power supplies.

What is claimed is:

1. A high-voltage relay, comprising:

a housing with a hollow coil-supporting base with a central pole piece, a guide tube secured to the base in coaxial alignment with the pole piece, and a plurality of stacked hollow ceramic rings secured to and extending from the base to a cover plate to define a sealed interior chamber;

a plunger assembly centrally positioned within the chamber, and having an insulating rod, a movable-contact conductive member secured to and extending along one end of the rod, and a ferromagnetic armature secured at the opposite end of the rod to extend into and make a slip fit within the guide tube;

a movable-contact terminal plate positioned between and sealed to an adjacent pair of ceramic rings and having a first external terminal and a central opening through which extends the conductive member, the plate supporting and being electrically connected to a pair of coil springs extending across the central opening and slidably bearing on opposite side surfaces of the conductive member;

a return spring disposed between the pole piece and the armature for urging the armature away from the pole piece, whereby the armature is spring-urged to a first position when the coil is not energized, and magnetically drawn to a second position when the coil is energized; and a first fixed contact secured to the housing and having a second external terminal, the fixed contact being in electrical connection with the conductive member in one of the positions to complete a circuit between the terminals.

2. The relay in claim 1 wherein the movable-contact terminal plate has a central opening, the plate further defining opposed pairs of tabs extending into the opening and configured to receive and mount the coil springs.

3. The relay defined in claim 1, wherein the first fixed contact is positioned on the cover plate.

4. The relay defined in claim 3, and further comprising a second fixed contact secured to the housing and spaced apart from the first fixed contact to be in electrical connection with the conductive member when the armature is in the other of said positions.

5. The relay defined in claim 4 wherein the movable-contact conductive member has a first contact surface at one end of the insulating rod adjacent the first fixed contact, and a second contact surface formed as a radially extending flange spaced from the first contact surface and positioned adjacent the second fixed contact.

6. The relay defined in claim 5 wherein the movable-contact terminal plate has a central opening, the plate further defining opposed pairs of tabs extending into the opening and configured to receive and mount the coil springs.

* * * * *